US009997313B2

(12) United States Patent
Hu

(10) Patent No.: US 9,997,313 B2
(45) Date of Patent: Jun. 12, 2018

(54) COMPOSITE EMBEDDED-POLE AND OPERATING PRINCIPLES

(71) Applicant: ZHEJIANG LIMITED CORPORATION OF DAODU INTELLIGENT SWITCH, Yuyao, Zhejiang (CN)

(72) Inventor: Guangfu Hu, Yuyao (CN)

(73) Assignee: ZHEJIANG LIMITED CORPORATION OF DAODU INTELLIGENT SWITCH, Zhejiang (CN)

( * ) Notice: Subject to any disclaimer, the term of this patent is extended or adjusted under 35 U.S.C. 154(b) by 0 days. days.

(21) Appl. No.: 15/506,888

(22) PCT Filed: Nov. 13, 2014

(86) PCT No.: PCT/CN2014/091007
§ 371 (c)(1),
(2) Date: Feb. 27, 2017

(87) PCT Pub. No.: WO2016/023284
PCT Pub. Date: Feb. 18, 2016

(65) Prior Publication Data

US 2017/0263400 A1 Sep. 14, 2017

(30) Foreign Application Priority Data

Aug. 15, 2014 (CN) ..... 2014 1 0403457

(51) Int. Cl.
*H01H 33/664* (2006.01)
*H01H 33/666* (2006.01)
*H01H 33/662* (2006.01)

(52) U.S. Cl.
CPC ..... *H01H 33/664* (2013.01); *H01H 33/666* (2013.01); *H01H 33/66207* (2013.01); *H01H 2205/002* (2013.01)

(58) Field of Classification Search
CPC ..... H01H 33/664; H01H 33/66207; H01H 33/666; H01H 33/662; H01H 2205/002;
(Continued)

(56) References Cited

U.S. PATENT DOCUMENTS 4,538,039 A * 8/1985 Gotoh ..... H01H 33/12 218/10
8,247,725 B2 * 8/2012 Morita ..... H01H 33/66207 218/140

(Continued)

FOREIGN PATENT DOCUMENTS

CN 201237999 Y 5/2009
CN 203434515 U 2/2014

(Continued)

OTHER PUBLICATIONS

May 28, 2015 International Search Report issued in International Patent Application No. PCT/CN2014/091007.

(Continued)

*Primary Examiner* — Renee S Luebke
*Assistant Examiner* — William Bolton
(74) *Attorney, Agent, or Firm* — Oliff PLC

(57) ABSTRACT

This invention involves composite embedded-pole and its operating principles, including an insulating cylinder which has upper and lower cavities, and one of its ends tightly connects a sealed cap. As for the upper cavity, there is an outlet block on the left end, a spacing-set pair of static conductive blocks which bond with each other in the middle, and a grounding block on the right. Parts of the left static conductive block inserts into the left of the lower cavity. The (Continued)

lead screw in the upper cavity is for rotary location with one end stretching out the sealed cap. The lead screw, spirally connects with moving contact set that matches with outlet block, static conductive block, and grounding block forming a 3-bonding-position. There is a vacuum interrupter in the lower cavity, whose static contact bonding with the left static conductive block, and the outer end of the moving contact flexibly couples with the left of the insulating pull rod. What's more, the flexible coupling bonds with one end of the lower outlet rod which is embedded in the lower part of the insulating cylinder. The right end of insulating pull rod stretches out the sealed cap while operating. This invention of EP is suitable for switchgears, with small volume, convenient and reliable installation and operation.

8 Claims, 2 Drawing Sheets

(58) Field of Classification Search
CPC .... H02B 13/01; H02B 13/035; H02B 13/075; H02B 1/56
USPC ..... 218/139, 134, 155, 10, 12, 118
See application file for complete search history.

(56) References Cited

U.S. PATENT DOCUMENTS

2001/0002666 A1* 6/2001 Ito ..... H02B 1/56 218/134
2005/0150869 A1* 7/2005 Vaghini ..... H01H 33/125 218/118
2010/0038343 A1* 2/2010 Sato ..... H01H 33/666 218/139
2011/0036811 A1* 2/2011 Utsumi ..... H01H 31/003 218/118
2012/0132622 A1* 5/2012 Yamazaki ..... H02B 1/56 218/118
2014/0175059 A1* 6/2014 Huang ..... H01H 33/66207 218/136

FOREIGN PATENT DOCUMENTS

CN 104201041 A 12/2014
CN 204117946 U 1/2015
CN 104409273 A 3/2015
CN 204257488 U 4/2015

OTHER PUBLICATIONS

Feb. 21, 2017 International Preliminary Report on Patentability issued in International Patent Application No. PCT/CN2014/091007.
Apr. 1, 2015 Search Report issued in International Patent Application No. PCT/CN2014/091026.
May 2, 2017 International Preliminary Report on Patentability issued in International Patent Application No. PCT/CN2014/091026.
U.S. Appl. No. 15/508,981, filed Mar. 6, 2017 in the name of Guangfu Hu.

* cited by examiner

COMPOSITE EMBEDDED-POLE AND OPERATING PRINCIPLES

TECHNICAL DOMAIN

This invention involves a kind of embedded-pole, which is a composite EP used for switchgears and its operating principles.

BACKGROUNDS

EP, shaping in form when conductive parts relating to vacuum interrupter and circuit breaker are simultaneously inserted into solid insulating materials which easily solidified like epoxy resin, is used to control switchgears. GIS RMU, using SF6 as insulating medium, tends to be obsolete for its toxicity against environmental requirements. Thus, there is a thriving development of new solid insulating, gas insulating, and composite insulating switchgears and devices. Among these devices, there are various structures for 3-position switchgears. For instance, vacuum tubes and VI components are embedded in a same insulating pole, while the cost of vacuum tube is pretty high. Other ways, neither rotary 3-position disconnectors composite with EP nor direct-driving 3-position disconnectors composite with EP, despite of the enhancing design in structures, have limits in miniaturization for high voltage electrical devices. Besides, putting two different components together has difficulties in coherence and has a heavy load of assembling work.

Just as published on the Chinese Patent Document, whose authorized announcement number is CN203434515U, on Feb. 12, 2014, the patent is called Disconnector and Circuit Breaker Composite Electrical Apparatus for GIS. It consists of CB operating mechanism, disconnector operating mechanism, EP, sealing plate, main loop and transmission mechanism of disconnector. CB operating mechanism and disconnector operating mechanism are integral in structures and fixed on one side of the sealing aluminum plate, and EP and the main loop of disconnector are fastened on the other side. The scheme mentioned above makes the whole structure more compact and also smaller in volume. However, it is obvious that the separate design of 3-position mechanism and EP takes a lot room and makes assembly cumbersome. Therefore, it is necessary to improve the existing EP.

DETAILS OF INVENTION

The invention adopts the following technical schemes to solve the deficiencies mentioned above.

A composite EP, including 3-position switch and VI components, has the two mentioned parts parallel set in a same insulating cylinder, which has upper and lower cavities. The 3-position switch is in the upper cavity, and VI is in the lower cavity. Right ends of the two cavities are both open and connect with a same sealed cap. There is an outlet block on the left end of the upper cavity, a pair of static conductive blocks spacing-set in the middle, i.e. the left static conductive block and the right static conductive block, bonding by conductive board inserted in the walls of the upper cavity. The right end is equipped with grounding block. The upper cavity is also fitted with a rotary lead screw for location with its right end stretching out of the sealed cap. The lead screw, spirally connects with a moving contact set, which is located in the upper cavity. The moving contact set has directional linear motion with outlet block, static conductive block and grounding block and while rotating along with the lead screw, axial motion makes it reach 3 positions: moving contact set bonding with outlet block reaches disconnecting closing with the left static conductive block; moving contact set bonding with two static conductive blocks, reaches disconnecting opening; moving contact set bonding with the right static conductive block, reaches grounding closing with grounding block. The lower cavity has VI and insulating pull rod. And lower end of the left static conductive block mentioned above inserts into the left end of the lower cavity, and fixedly bonding with the static contact of VI. The right end of moving contact of VI matching with flexible coupling, fixedly connects with the left end of the insulating pull rod and one end of the lower outlet rod. The right end of the insulating pull rod stretches out of the sealed cap.

The rotating of the lead screw leads to the moving contact set axial motion, and then realizes the switchover of positions in a simple and reliable way with long mechanical endurance. Setting 3-position structure and VI in a same insulating cylinder enables the spatial layout compact, decreases the assembling volume, expedites assembly and is applicable in more extensive ways.

Inside the moving contact set, fixedly set the insulating driving nut, composing with the lead screw, which is insulating, as screw pair, to spirally drive. This structure makes the insulation between conductive parts of composite EP and the outer operating mechanism leading the rotation of lead screw come true. Moreover, it is convenient to assemble and maintain.

Located in the left end of the upper cavity, the bearing block and the inner bore of the sealed cap is installed with deep groove ball bearings that locate in position with the two ends of lead screw. This structure avails the installation of lead screw, putting it successfully installed in the center of 3-position disconnector and earthing switch with flexible rotation.

There are spring contacts embedded in the grooves where moving contact sets separately touching with outlet block, static conductive block, grounding block. The setting of spring contact improves the reliability of conductivity.

The lead screw, insulating pull rod and sealed cap is tightened by skeleton seal rings, which not only won't affect the motion of lead screw and insulating pull rod, but enjoys a good-quality of tightness avoiding any accident caused by the entering of dirt in the insulating cylinder.

The insulating pull rod and the moving contact are threaded connected, with one end of flexible coupling fastened in the joint of thread, and the other end fastened with the lower outlet rod by bolt. This structural connection is more expedite and reliable.

The operating principles of this composite EP are as followings: rotate the lead screw clockwise or counterclockwise to make the moving contact sets axially move along with the lead screw. While the moving contact sets reach to the left end of the upper cavity, they are bonding with the outlet block and the left static conductive block; while they reach to the middle of the upper cavity, they are bonding with the two static conductive blocks; while they are at the right end of the upper cavity, they are bonding with the right static conductive block and the grounding block. These three bonding locations realize the function of the 3-position disconnecting earthing switch. By exogenic forces, the insulating pull rod is able to make the moving contact and static contact of VI closing or opening, and then through the lower outlet rod make the main switch locate in closing or opening position.

The 3-position switch, applied as 2-position disconnector and VI components or earthing switch and VI components, all includes in the 3-position disconnector earthing switch and VI components.

Owing to its compact structure, smaller volume, lower cost, convenient and reliable installation and longer endurance, this invention is applicable for EPs of various switchgears or available as a structural improvement for similar products.

INSTRUCTIONS FOR DRAWINGS

MODE OF EXECUTION

Figure 1:
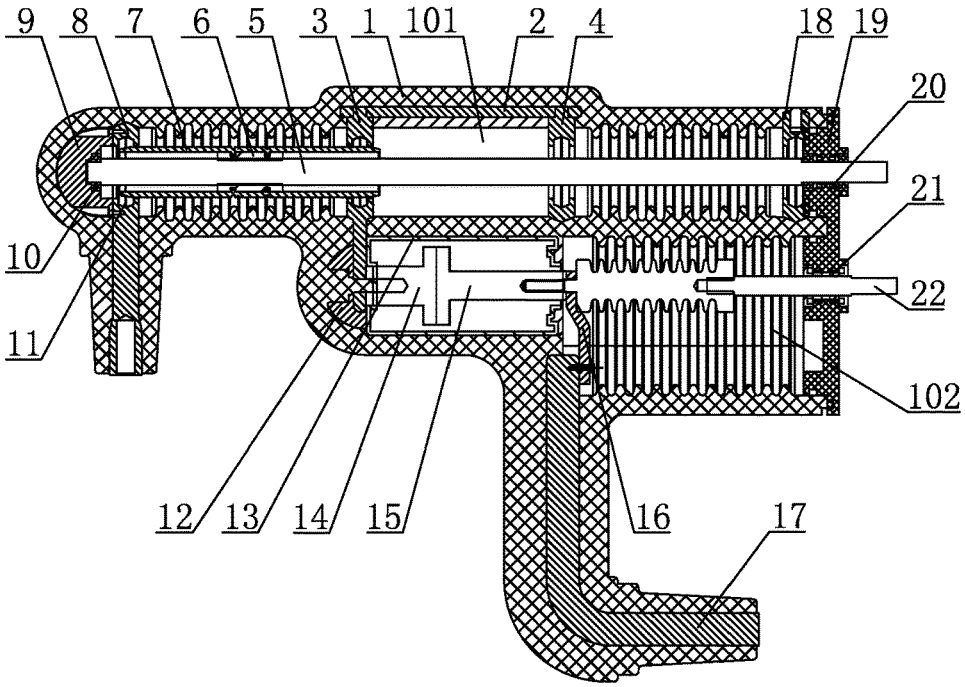
FIG. 1 is the internal structure when it is located in disconnecting and closing position.

Further descriptions for the invention with drawings: Just as FIG. 1 to FIG. 4 illustrated, the main body of this composite EP is an insulating cylinder (1), which can be divided into two parallel and spacing-set cavities, i.e. the upper cavity (101) and the lower cavity (102). The right ends of both cavities are open, and sealed to join with sealed cap (19). The internal structures of the composite EP are as followings: the left end of the upper cavity is embedded with bearing block (9) and outlet block (8) and the two are fastened with bolts. There is deep groove ball bearing (10) in the bearing block. In the middle of the upper cavity separately set a pair of static conductive blocks, i.e. the left static conductive block (3) and the right static conductive block (4). The two electrically connect by the conductive board (2) embedded in the upper cavity wall. The right end embeds the grounding block. The bore is equipped with the deep groove ball bearing which has the same axis with the deep groove ball bearing mentioned above.

In the upper cavity, there is an insulating lead screw (5), whose left end is located with the deep groove ball bearing that is on the left of the upper cavity. The right end of the lead screw is located with the deep groove ball bearing which is set in the upper side of the sealed cap in the right end of the upper cavity, and stretches out of the sealed cap. The lead screw and the sealed cap are tightened by skeleton seal ring (20). The lead screw and insulating driving nut (6) compose screw pair, and the driving nut and the inner wall of moving contact set are located and fastened. The moving contact set travel in directional linear motion with outlet block, static conductive block and grounding block and the joining grooves between the moving contact set and them are embedded with spring contacts (11). While rotating along with the lead screw, axial motion makes it reach 3 positions: moving contact set bonding with outlet block reaches disconnecting and closing position along with the left static conductive block; moving contact set bonding with two static conductive blocks reaches disconnecting and opening position; moving contact set bonding with the right static conductive block reaches earthing and closing position along with grounding block.

The lower cavity is fitted with VI (13), including static contact (14) and moving contact (15), and insulating pull rod (22). The lower end of the left static conductive block is embedded in the left end of the lower cavity and electrically connects with the left end of static contact by the fixed block (12). The outer end of moving contact stretches out VI and threaded connects with insulating pull rod. The threaded joint locks and fastens with one end of flexible coupling (16), while the other end is fastened and electrically connected with one end of the lower outlet rod (17) embedded in the lower part of insulating cylinder by bolts. The right end of the insulating pull rod reaches out of the sealed cap and the two operate and match by skeleton seal ring (20) and sleeve (21).

To illustrate the operating processes, we will put these 3 processes as examples: disconnecting closing, disconnecting opening, and earthing closing.

First of all, set the VI in opening and keep the main switch off before any switchover of positions. When it reaches any position, such as disconnecting closing, disconnecting opening, or earthing closing, set the VI in closing or opening position.

For example, when it is in the disconnecting closing as FIG. 1, if you want to set it in disconnecting opening operation, set the VI in opening, which means that separate the moving contact from static contact, and then rotate the lead screw. The lead screw will force the moving contact set move till put the two static conductive blocks electrically connect result in reaching the condition as FIG. 2.

Figure 2:
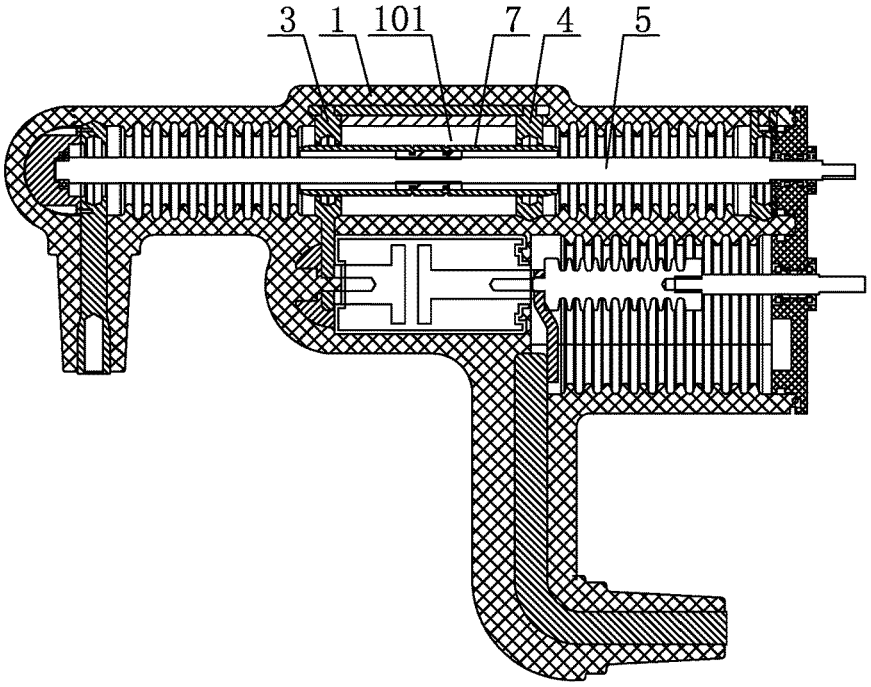
FIG. 2 is the internal structure when it is located in disconnecting and opening position.
Figure 3:
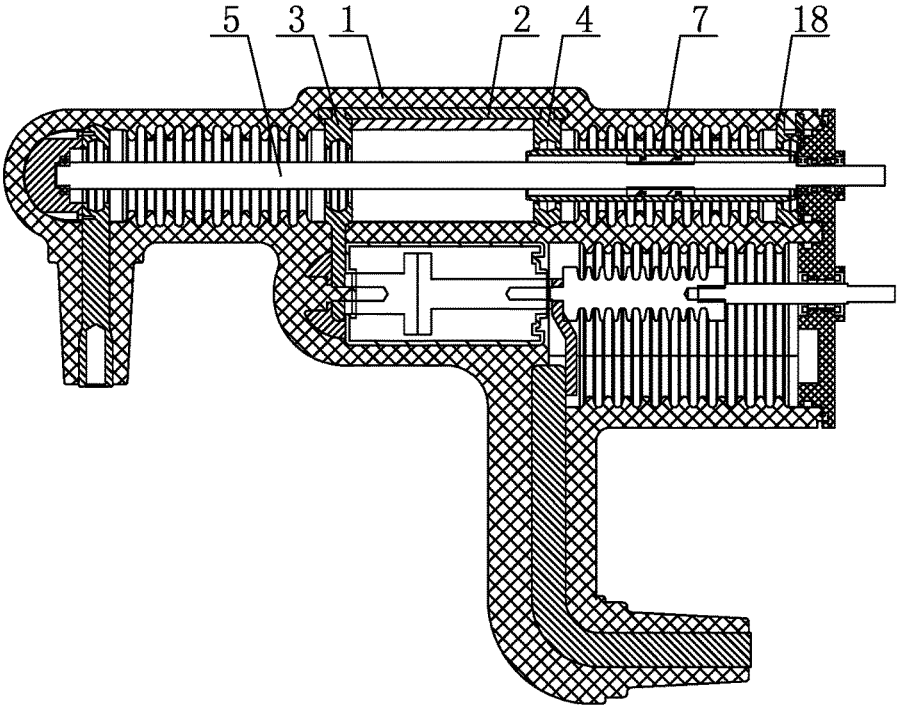
FIG. 3 is the internal structure when it is located in earthing and closing position.
Figure 4:
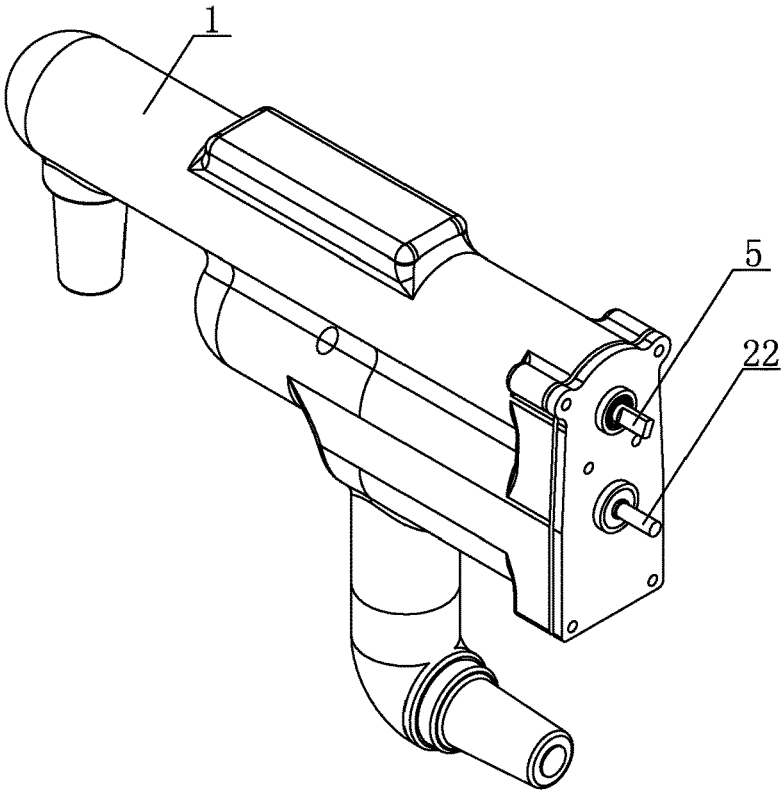
FIG. 4 is the dimensional structure.

When it is in the disconnecting opening condition as FIG. 2 shows, if you want to make the main switch close, a disconnecting closing operation is the first thing to do. Rotate the lead screw which leads the moving contact set move until it leads to an electrical connection between outlet block and the left static conductive block. By exogenic forces, the insulating pull rod is able to make the moving contact and static contact close, which accomplishes disconnecting closing operation and reaches the condition of FIG. 1.

When it is in the disconnecting opening position, if you want to run an earthing closing operation, first rotate the lead screw, which leads the moving contact set motion until the right static conductive block and grounding block are electrically connected. By exogenic forces, the insulating pull rod is able to make the moving contact and static contact close, which accomplishes earthing closing operation and reaches the condition of FIG. 3.

All the details above are to demonstrate the technological means of this invention, not to limit the technical scope. Besides, any improvement of this invention made by technicians of this domain applying public knowledge is also within the extent of this patent's right.

The invention claimed is:

1. A composite embedded-pole (EP), comprising:

a 3-position disconnector earthing switch; and components of a vacuum interrupter (VI), wherein the 3-position disconnector earthing switch and the components of the VI are parallelly set in a same insulating cylinder, the cylinder has an upper cavity and a lower cavity, the 3-position disconnector earthing switch is in the upper cavity, the VI is in the lower cavity, and a right end of the upper cavity and a right end of the lower cavity are both open and connect with a same sealed cap, an outlet block is on a left end of the upper cavity, a grounding block is on the right end of the upper cavity, and a pair of spacing-set static conductive blocks, which includes a left static conductive block and a right static conductive block, is in a middle of the upper cavity, the pair of spacing-set static conductive blocks being bonded with a conductive board inserted in walls of the upper cavity, the upper cavity includes a rotary lead screw, the rotary lead screw having a right end that extends out of the sealed cap, and the rotary lead screw spirally connects with a moving contact set in the upper cavity, the moving contact set has directional linear motion with the outlet block, the left static conductive block, the right static conductive block, and the grounding block, and while rotating along with the rotary lead screw, axial motion causes the rotary lead screw to reach 3 positions, the 3 positions comprising: (i) the moving contact set bonding with the outlet block, and reaches a disconnecting closing position with the left static conductive block; (ii) the moving contact set bonding with the left static conductive block and the right static conductive block, and reaches a disconnecting opening position; and (iii) the moving contact set bonding with the right static conductive block, and reaches an earthing closing position with the grounding block, and the lower cavity includes the VI and an insulating pull rod, a lower end of the left static conductive block inserts into the left end of the lower cavity, and fixedly bonds with a static contact of the VI, an outer end of a moving contact of the VI fixedly connects with the left end of the insulating pull rod, by matching with flexible coupling which bonds with one end of a lower outlet rod, and a right end of the insulating pull rod extends out of the sealed cap.

2. The composite EP according to claim 1, wherein an insulating driving nut is fastened in the moving contact set, rotary lead screw and the insulating driving nut form a screw pair for spiral transmission, and the rotary lead screw includes an insulating material.

3. The composite EP according to claim 1, wherein, in the left end of the upper cavity, a bearing block and an inner bore of the sealed cap are installed with deep groove ball bearings that are used to locate two ends of the rotary lead screw.

4. The composite EP according to claim 1, wherein spring contacts are embedded in grooves in which moving contact set separately touches the outlet block, a static conductive block, and the grounding block.

5. The composite EP according to claim 1, wherein the rotary lead screw, the insulating pull rod and the sealed cap are tightened by skeleton seal rings.

6. The composite EP according to claim 1, wherein the insulating pull rod and the moving contact are threaded connected, with one end of flexible coupling locked and fastened in a joint of thread, and another end of the flexible coupling fastened with the lower outlet rod by bolt.

7. The composite EP according to claim 1, wherein the rotary lead screw rotates clockwise or counterclockwise to cause the moving contact set move linearly, when the moving contact set reaches the left end of the upper cavity, the moving contact set bonds, at a first bonding location, with the outlet block and the left static conductive block, when the moving contact set is in the middle of the upper cavity, the moving contact set bonds, at a second bonding location, with the left static conductive block and the right static conductive block, when the moving contact set is at the right end of the upper cavity, the moving contact set bonds, at a third bonding location, with the right static conductive block and the grounding block, the first bonding location, the second bonding location and the third bonding location include functions of the 3-position disconnector earthing switch, by exogenic forces, the insulating pull rod is configured to cause the moving contact and the static contact of the VI to close or open, and then using the lower outlet rod to cause a main switch to be located in a closing or opening position.

8. The composite EP according to claim 7, wherein the 3-position disconnector earthing switch and the VI components are configured to be applied as a 2-position disconnector switch and VI components, or an earthing switch and VI components.

* * * * *